US005895118A

United States Patent [19]

Hensley

[11] Patent Number: 5,895,118

[45] Date of Patent: Apr. 20, 1999

[54] COMBINATION BEACH TOWEL AND BAG

[76] Inventor: Charles D. Hensley, 5205 N. Somerset La., Alpharetta, Ga. 30005

[21] Appl. No.: 09/003,213

[22] Filed: Jan. 6, 1998

[51] Int. Cl.[6] ..... B65D 30/10

[52] U.S. Cl. ..... 383/3; 383/4; 383/13; 383/40; 383/76; 383/111; 383/117; 5/417

[58] Field of Search ..... 383/3, 4, 76, 111, 383/40, 6, 13, 117; 5/417

[56] References Cited

U.S. PATENT DOCUMENTS

| | | | |
|---|---|---|---|
| 3,041,638 | 7/1962 | Lo Vico | 383/4 X |
| 4,671,393 | 6/1987 | Rainey | 383/4 X |
| 4,738,545 | 4/1988 | Westgor . | |
| 4,794,029 | 12/1988 | Tennant et al. . | |
| 4,856,912 | 8/1989 | Damus et al. . | |
| 4,886,150 | 12/1989 | Fitzsimmons | 383/4 X |
| 4,991,978 | 2/1991 | Ostrowski . | |
| 5,187,823 | 2/1993 | Ferguson et al. . | |
| 5,219,219 | 6/1993 | Virdin, Jr. | 383/4 |
| 5,288,150 | 2/1994 | Bearman | 383/117 X |
| 5,429,541 | 7/1995 | Landon . | |
| 5,482,374 | 1/1996 | Buhyoff . | |
| 5,819,343 | 10/1998 | Zampirri, Jr. et al. | 383/4 X |

FOREIGN PATENT DOCUMENTS

| | | | |
|---|---|---|---|
| 578247 | 1/1994 | European Pat. Off. | 383/4 |

*Primary Examiner*—Jes F. Pascua
*Attorney, Agent, or Firm*—William B. Noll

[57] ABSTRACT

Disclosure directed to the combination of a beach towel convertible to a bag for transporting items to and from the beach. The combination includes a uniquely constructed, circular mat having an inflatable peripheral bladder member that facilitates set-up of the mat, and ensures a maintenance of the components thereof. The combination further includes a removably detachable towel for the mat, and a security pouch for personal items on the mat underlying the towel.

8 Claims, 1 Drawing Sheet

COMBINATION BEACH TOWEL AND BAG

FIELD OF THE INVENTION

The present invention is directed to the field of beach or pool-side accessories, particularly an accessory in the form of beach towel assembly that may be readily converted into a carrying bag for transporting various items to the beach, for example.

BACKGROUND OF THE INVENTION

The invention relates to the combination of a beach towel that is convertible to a carrying bag, for use in transporting personal items to enhance one's visit to the beach. Often times when one wishes to visit a beach it can be a day long venture which, for convenience, requires the transporting of a number of items, such as a radio or similar entertainment system, food, keys, suntan lotion, extra towels, and the possibility of toys to entertain children.

There are a variety of prior art devices to assist the beach goer as reflected in the following U.S. Patents, but none offer the convenience, use and ease of set-up as found in the present invention. Such prior art patents are as follows:

a.) U.S. Pat. No. 5,482,374, to Buhyoff, discloses a beach towel constructed with a polygonal center panel from which extend separate trapezoidal panels to create a towel with a substantially polygonal perimeter. The panels are sewn together to provide a strong reinforced structure, and a drawstring around the perimeter permits conversion of the towel into a bag-like structure.

b.) U.S. Pat. No. 5,429,541, to Landon, discloses a portable sand blanket with associated toys including a blanket formed in a flat circular configuration of a durable plastic material, the blanket having six holes therethrough located at essentially equally spaced locations adjacent to the periphery, grommets positioned through the holes of the blanket and a single rope in a circular configuration threaded sequentially through the holes and grommets, where the rope extends on the upper and lower surfaces of the blanket alternatively. The blanket further includes a central container for sand, and associated tools.

c.) U.S. Pat. No. 5,187,823, to Ferguson et al., discloses an article capable of being configured as a blanket or tote bag. The article is made of a fabric piece having two opposing arcuate fabric channel halves secured to the lower surface thereof, facing each other. The channel halves define a generally circular channel in the center of the fabric piece. Gaps between the opposing ends of the fabric channel halves expose at least one and preferably two separate continuous ropes which pass through the channel. The fabric piece has a generally circular central portion of smaller diameter than the channel, with at least one retaining loop secured near the circumference thereof. A carrying bag may be formed by folding those portions of the fabric piece which are outside the channel upwardly and in towards the center of the fabric piece, thereby exposing the ropes in the gaps, by then pulling the ropes to bunch the fabric channel halves thereon, and by then routing the pulled ropes through at least one retaining loop and tying them to define a carrying loop in the fashion of a shoulder strap.

d.) U.S. Pat. No. 4,991,978, to Ostrowski, discloses a towel bag combination which in the open position is used for towel or beach-type purposes and in the closed position is an enclosed bag with a carrying strap. The towel bag combination comprises a circular fabric towel element with a reinforced peripheral web with draw holes in the web and a ring near the web, and with the bottom surface having a reinforced section and a loop secured thereto. The towel-bag apparatus also includes an elastic draw cord having a one and an other end and passing through the holes in the web and having the one and other end include a spring loaded clip.

e.) U.S. Pat. No. 4,856,912, to Damus et al., discloses a beach towel which is selectively convertible to a beach bag wherein the towel has upper and lower surface portions having a generally annularly oriented pull cord substantially confined therebetween but extending outwardly on opposite sides of the towel so that as the outwardly extending portions of the pull cord are raised, the central portion of the towel surrounded by the pull cord will form a carrying pouch having an opening which is closed by the pull cord.

f.) U.S. Pat. No. 4,794,029, To Tennant et al., discloses a towel convertible to a bag, comprising a circular section of woven terry fabric, with a circular section of woven nylon fabric having precisely one-fourth the area of the circular woven terry fabric attached to the inferior plane of the circular woven terry fabric, which has four sections of woven terry fabric cut on the bias and of equal lengths and widths attached along the perimeter on both the superior and inferior planes to form a casing encompassing a cotton cord or drawstring thereby allowing conversion of the fabrics into a bag.

g.) U.S. Pat. No. 4,738,545, to Westgor, discloses a combination mat and carry bag unit including a sheet of pliable material defining a mat of a size to accommodate a person thereon for use as an exercise mat, beach mat or the like. The sheet has a drawstring casing extending about its periphery. The casing has two openings therein on opposite sides of the mat and a drawstring is received in the drawstring casing and is of a size to extend continuously about the periphery of the sheet where it defines a mat. The drawstring is slidably received in the drawstring casing so that when portions of the drawstring are pulled out of the drawstring casing through the two openings, the periphery of the sheet forms gathers adjacent the casing to permit the periphery to reduce in size whereby the unit forms a carrying bag.

The present invention includes some features of the prior art, but through the unique incorporation therein of new components or features results in a distinctly different combination that offers advantages not seen nor appreciated in the prior art. The manner by which these new advantages are realized will become apparent from the following description, particularly when read in conjunction with the accompanying drawings.

SUMMARY OF THE INVENTION

The invention relates to the combination of a beach towel convertible to a carrying bag, where the combination offers a quick and easy set-up to the user at the beach or pool side. The combination comprises a first circular panel having a peripheral reinforced portion, with inner and outer edges and containing plural grommet holes thereabout, and a draw cord passing through the holes. The periphery further includes an inflatable bladder member secured to and surrounding the outer edge. Additionally, a second, web-like circular panel is secured to the inner edge of the peripheral portion. Further, a removably detachable circular towel is provided to overlie at least the second, web-like circular panel, where the towel includes temporary fastening means about its periphery for attachment to complementary fastening means about the peripheral reinforced portion. Finally, a security pouch is secured to the web-like circular panel underlying the circular towel. To operate or set-up, inflation of the bladder member will extend and sustain the relationship of the combination, where deflating of the bladder member will allow the combination to be converted into a bag by pulling on the draw cord.

Accordingly, an object of the present invention is to provide a beach accessory to enhance the pleasure and comfort of the user thereof at the beach or pool side.

A further object hereof is the provision for easy set-up of the combination for sunning on a beach, while offering a sense of security for storing personal items for the user during time in the water.

Still another object of this invention is to give the user the convenience of transporting objects to and from the beach.

These and other objects will become apparent to those skilled in the art from a reading of the following specification.

DETAILED DESCRIPTION OF PREFERRED EMBODIMENT

Figures 1, 2, 3:
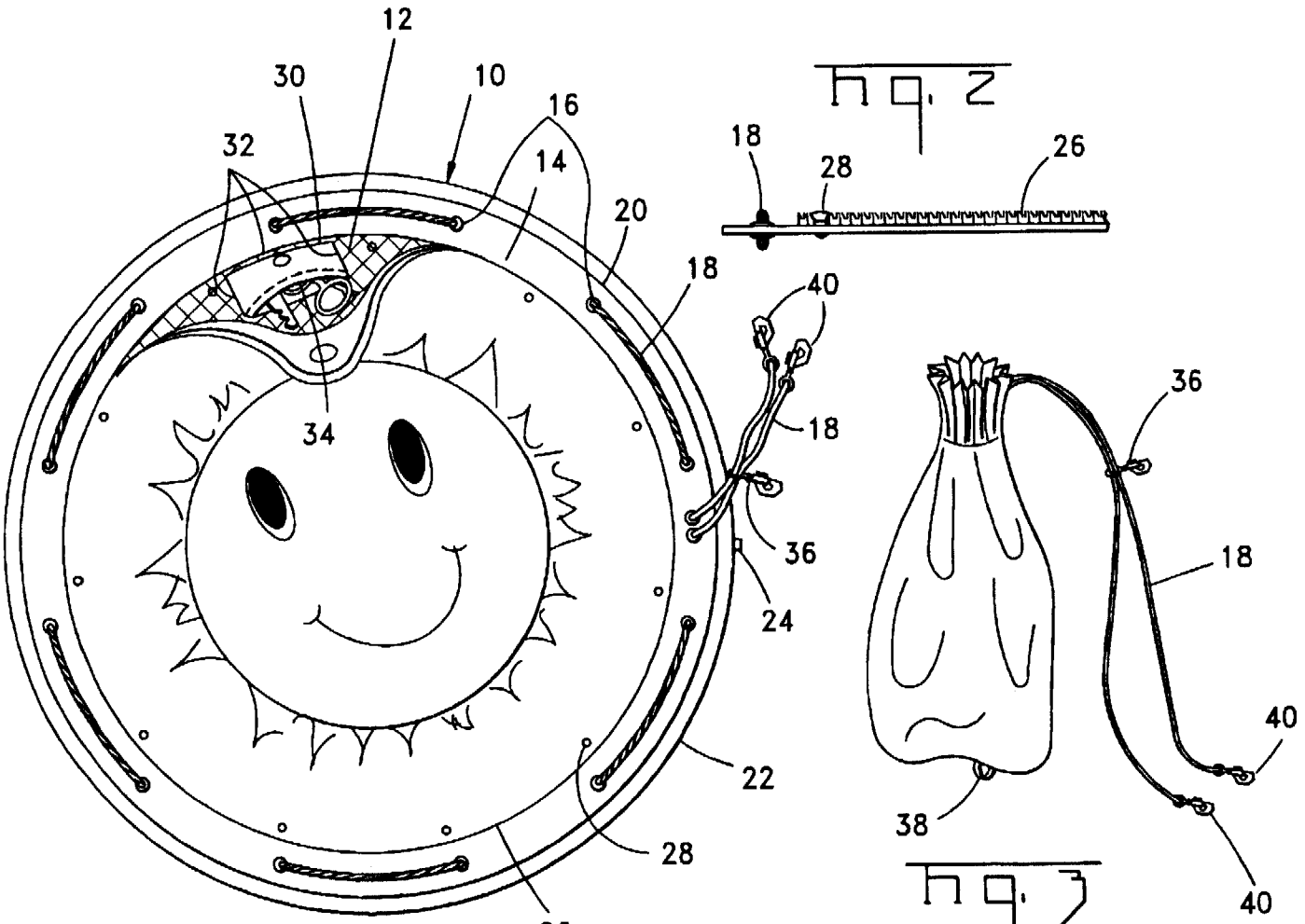
FIG. 1 is a top plan view of a combination beach towel and bag according to the present invention, illustrating the incorporation thereof of a normal hidden security pouch for storing personal items.
FIG. 2 is a partial sectional view of the beach towel combination, showing the means for temporarily securing a circular towel to the combination.
FIG. 3 is a side view of the beach towel combination of FIG. 1 showing the convenient form of transporting the combination.

The present invention is directed to the combination of a beach towel assembly which may be converted to a bag for transporting items to the beach. Referring to the several Figures, where like reference numerals represent like components or features throughout the several views, the beach towel assembly 10 comprises a central circular panel 12, preferably of open mesh construction to ensure against entrapping sand after use. Surrounding the central circular panel 12 is a peripheral, reinforced section 14 containing a plurality of spaced apart holes 16, having grommets therein. Laced through said holes, in a weave like fashion, is a draw cord 18, either continuous or of a discrete length, the function of which will become clearer in regard to FIG. 3.

Surrounding the outer edge 20 of reinforced section 14 is an inflatable bladder 22, or tube, having a valve 24 to inflate or deflate, as desired. Upon inflation of the bladder 22, the circular panel 12 and reinforced section 14 are stretched into a neat planar assembly for placement on the sand.

Overriding the central circular panel 12 and an inner portion of the reinforced section 14 is a removably detachable, circular towel 26. Around the periphery of the towel 26 are a plurality of fastening members 28, such as snaps or a Velcro-type fastener. As known in the art, a Velcro-type fastener is a fabric fastener consisting of a first component of plural hooks and a complementary fabric fastener of a dense fabric pile. In either case, a complementary fastening member is affixed to the inner portion of the reinforced section 14, see FIG. 2. By this arrangement, a soiled towel, such as from suntan oil, sand or food, can be readily detached, washed and replaced as desired.

To provide a convenient means to store personal items, such as keys, a watch, etc., a security pouch 30 may be provided on the central circular panel 12, preferably near the reinforced section 14. The pouch, secured along three sides 32, includes a fourth open side 34, that may be closed, such as by a flap or Velcro-type fasteners, to secure the contents thereof. With the towel 26 overlying the pouch 30, the pouch is not visibly apparent thus providing a sense of security to the user when away from the beach towel assembly 10.

With the beach towel assembly 10 so easily set-up, the user thereof may quickly enjoy the sun and beach. After a leisure day, the beach towel assembly may just as quickly be picked up and transported. After deflating the bladder 22, and placing all loose items in the middle of the towel 26, the draw cord 18, with the assistance of the sliding element 36, such as a spring biased hook, may be used to draw the assembly into the bag configuration illustrated in FIG. 3. After pulling tightly the draw cord 18, the sliding element 36 may be secured to a loop 38 centrally disposed and projecting from the bottom of the central panel 12. In the absence of a continuous draw cord 18, the respective ends of the draw cord may each be provided with a spring biased hook 40 which can be secured to one another, or to the loop 38. By this arrangement, a convenient carrying strap is provided for transporting the beach towel assembly 10.

While a preferred embodiment for the beach towel combination has been described above it is recognized that variations may be had with respect to the combination in accordance with this invention. Therefore, while the invention has been disclosed in a preferred form only, it will be obvious to those skilled in the art that many additions, deletions and modifications can be made therein without departing from the spirit and scope of this invention, and no undue limits should be imposed thereon except as set forth in the following claims.

I claim:

1. The combination of a beach towel convertible to a carrying bag, the combination comprising:

a.) a first circular panel having a peripheral reinforced portion with inner and outer edges and containing plural grommet holes thereabout, and a draw cord passing through said holes;

b.) an inflatable bladder member secured to and surrounding said outer edge of the peripheral portion;

c.) a second web-like circular panel secured to said inner edge of the peripheral portion;

d.) a removably detachable circular towel to overlie at least said second web-like circular panel, said towel including temporary fastening means about its periphery for attachment to complementary fastening means about said peripheral reinforced portion; and, e.) a security pouch secured to said web-like circular panel underlying said circular towel, whereby inflation of said bladder member will extend and sustain the relationship of said combination, and deflating of said bladder member will allow said combination to be converted into a bag by pulling on said draw cord.

2. The combination according to claim 1, wherein the free ends of said draw cord include spring biased hooks, and the underside of said web-like panel includes a loop for engaging said hooks, whereby to provide a convenient carrying strap for the user to transport said combination to and from its place of use.

3. The combination according to claim 1, wherein said means for temporarily securing said towel to said peripheral portion include plural snap engaging fasteners.

4. The combination according to claim 1, wherein said means for temporarily securing said towel to said peripheral portion include complementary fabric-type fasteners having an array of hooks and dense pile for pressing thereagainst.

5. The combination according to claim 1, wherein said security pouch includes means for closing same to further protect the stored contents thereof.

6. The combination according to claim 2, wherein said draw cord further includes a sliding element to facilitate closing said combination into a transportable bag.

7. The combination according to claim 6, wherein said sliding element comprises a spring biased hook for engaging said loop in the transportable condition.

8. The combination according to claim 1, wherein said web-like panel includes openings therein to allow for the release of sand that may accumulate between said web-like panel and said circular towel.

* * * * *